US006532613B2

(12) United States Patent
Berry, IV

(10) Patent No.: US 6,532,613 B2
(45) Date of Patent: Mar. 18, 2003

(54) THREE DIMENSIONAL STAR SHAPED PLIABLE CHAIR

(76) Inventor: Russell M. Berry, IV, 8166 Tecopa Way, Sacramento, CA (US) 95828-5761

( * ) Notice: Subject to any disclaimer, the term of this patent is extended or adjusted under 35 U.S.C. 154(b) by 0 days.

(21) Appl. No.: 09/877,461

(22) Filed: Jun. 7, 2001

(65) Prior Publication Data

US 2002/0184709 A1 Dec. 12, 2002

(51) Int. Cl.[7] ..... A47C 5/00

(52) U.S. Cl. ..... 5/655.4; 5/654; 5/911

(58) Field of Search ..... 5/653, 654, 655.3, 5/655.4, 655.9, 644, 702, 706, 707, 711, 712, 740, 911, 953; D6/601

(56) References Cited

U.S. PATENT DOCUMENTS

| | | | | | |
|---|---|---|---|---|---|
| D25,823 | S | * | 7/1896 | Shaw | D6/349 |
| D29,760 | S | * | 2/1898 | Bartlett | D6/349 |
| 2,298,218 | A | * | 10/1942 | Madson | 5/702 X |
| 2,434,641 | A | * | 1/1948 | Burns | 5/654 X |
| 2,738,834 | A | * | 3/1956 | Jaffe et al. | 5/420 |
| 3,273,180 | A | * | 9/1966 | Feinerman | 5/655.9 |
| 3,293,671 | A | * | 12/1966 | Griffin | 5/655.9 |
| 3,605,145 | A | * | 9/1971 | Graebe | 5/706 |
| 3,846,857 | A | * | 11/1974 | Weinstock | 5/740 X |
| 3,899,210 | A | * | 8/1975 | Samhammer et al. | 5/911 X |
| 3,959,835 | A | * | 6/1976 | Nos | 5/706 |
| 4,011,611 | A | * | 3/1977 | Lederman | 5/911 X |
| 4,027,888 | A | * | 6/1977 | Wilcox | 5/911 X |
| D255,854 | S | * | 7/1980 | Gay | D6/201 |
| 4,213,213 | A | * | 7/1980 | Burnett | 5/653 X |
| 4,275,473 | A | * | 6/1981 | Poirier | 441/128 |
| 4,405,129 | A | * | 9/1983 | Stuckey | 5/654 X |
| 4,541,136 | A | * | 9/1985 | Graebe | 5/706 X |
| 4,577,358 | A | * | 3/1986 | Glass | 5/911 X |
| 4,685,163 | A | * | 8/1987 | Quillen et al. | 5/644 X |
| 4,698,864 | A | * | 10/1987 | Graebe | 5/654 |
| 4,928,337 | A | * | 5/1990 | Chauncey | 5/740 X |
| 5,018,790 | A | * | 5/1991 | Jay | 5/653 X |
| 5,044,030 | A | * | 9/1991 | Balaton | 5/654 X |
| 5,052,068 | A | * | 10/1991 | Graebe | 5/654 |
| 5,152,023 | A | * | 10/1992 | Graebe | 5/655.3 |
| 5,163,196 | A | * | 11/1992 | Graebe et al. | 5/944 X |
| 5,243,722 | A | * | 9/1993 | Gusakov | 5/644 X |
| 5,304,271 | A | * | 4/1994 | Gusakov | 5/707 X |
| 5,360,653 | A | * | 11/1994 | Ackley | 5/740 X |
| 5,369,828 | A | * | 12/1994 | Graebe | 5/654 |
| 5,437,070 | A | * | 8/1995 | Rempp | 5/636 |
| 5,461,741 | A | * | 10/1995 | Graebe | 5/654 |
| 5,502,855 | A | * | 4/1996 | Graebe | 5/944 X |
| 5,533,220 | A | * | 7/1996 | Sebag et al. | 5/654 |
| 5,551,107 | A | * | 9/1996 | Graebe | 5/654 |
| 5,561,875 | A | * | 10/1996 | Graebe | 5/654 X |
| 5,596,781 | A | * | 1/1997 | Graebe | 5/654 X |
| 5,613,257 | A | * | 3/1997 | Graebe | 5/654 |
| 5,689,845 | A | * | 11/1997 | Sobieralski | 5/655.3 X |
| D390,406 | S | * | 2/1998 | Nelson | D6/601 |
| D390,407 | S | * | 2/1998 | Spinks | D6/601 |

(List continued on next page.)

*Primary Examiner*—Robert G. Santos
(74) *Attorney, Agent, or Firm*—Gray Cary Ware & Freidenrich LLP

(57) ABSTRACT

A pliable chair, for supporting the extremities of a user, that includes a hollow shell made of a pliable material and particulate material contained within the shell. The shell includes five upper panels attached together to form an upper surface, five lower panels attached together to form a lower surface, and five side panels each attached to one of the upper panels and to one of the lower panels. Five compartments are formed by the shell and extend from a central portion of the shell in a star shape. Each compartment is defined by one of the upper panels, one of the lower panels, and one of the side panels attached to the one upper panel and the one lower panel. As a user sits on the center portion, a portion of the particulate material shifts into the compartments and provides anatomically correct support for the user.

16 Claims, 6 Drawing Sheets

U.S. PATENT DOCUMENTS

D397,575 S * 9/1998 Miller ..... D6/600
5,839,140 A * 11/1998 Wilkerson ..... 5/654
D402,494 S * 12/1998 Langer ..... D6/601
6,189,168 B1 * 2/2001 Graebe ..... 5/644
D441,207 S * 5/2001 Williams ..... D6/358
D450,940 S * 11/2001 Dhing ..... D6/349
6,360,388 B2 * 3/2002 Langer ..... 5/632
6,386,761 B1 * 5/2002 Bohnsack ..... 383/24

* cited by examiner

THREE DIMENSIONAL STAR SHAPED PLIABLE CHAIR

FIELD OF THE INVENTION

The present invention relates to chairs, and more particularly to a star shaped pliable "bean bag" chair.

BACKGROUND OF THE INVENTION

Bean bag chairs are well known in the art. These chairs typically are comprised of a pliable round bag filled with particulate such as pellets or beads. The pliable bag is under-filled with the particulate, which is displaced as the user sits on the chair so the chair generally conforms to the body when the user sits down. While such chairs are quite popular, they fail to provide an anatomically correct and adjustable support for the head, arms and legs.

SUMMARY OF THE INVENTION

The present invention is a star-shaped pliable chair that provides a comfortable dedicated support compartment for each of the user's legs, arms and head, so that the user is supported in an anatomically correct manner.

The pliable chair of the present invention supports a user's extremities, and includes a hollow shell made of a pliable material and particulate material contained within the shell. The shell includes a center portion and at least five compartments extending therefrom. As a user sits on the center portion, a portion of the particulate material shifts into the compartments and provides support for the user's extremities.

In another aspect of the present invention, the pliable chair for supporting a user's extremities includes a hollow shell made of a pliable airtight material, and air contained within the shell. The shell includes a center portion and at least five compartments extending therefrom. As a user sits on the center portion, a portion of the air shifts into the compartments and provides support for the user's extremities.

In yet another aspect of the present invention, the pliable chair includes a hollow shell made of a pliable material and foam material contained within the shell. The shell includes a center portion and at least five compartments extending therefrom. As a user sits on the center portion, a portion of the foam material compresses in the compartments and provides support for the user's extremities.

In yet one more aspect of the present invention, the pliable chair includes a hollow shell made of a pliable material and particulate material contained within the shell. The shell includes five upper panels attached together to form an upper surface, five lower panels attached together to form a lower surface, and five side panels each attached to one of the upper panels and to one of the lower panels. Five compartments extend from a central portion of the shell in a star shape, each compartment is defined by one of the upper panels, one of the lower panels, and one of the side panels attached to the one upper panel and the one lower panel. As a user sits on the center portion, a portion of the particulate material shifts into the compartments and provides support for the user's extremities.

Other objects and features of the present invention will become apparent by a review of the specification, claims arid appended figures.

DETAILED DESCRIPTION OF THE PREFERRED EMBODIMENTS

Figure 1:
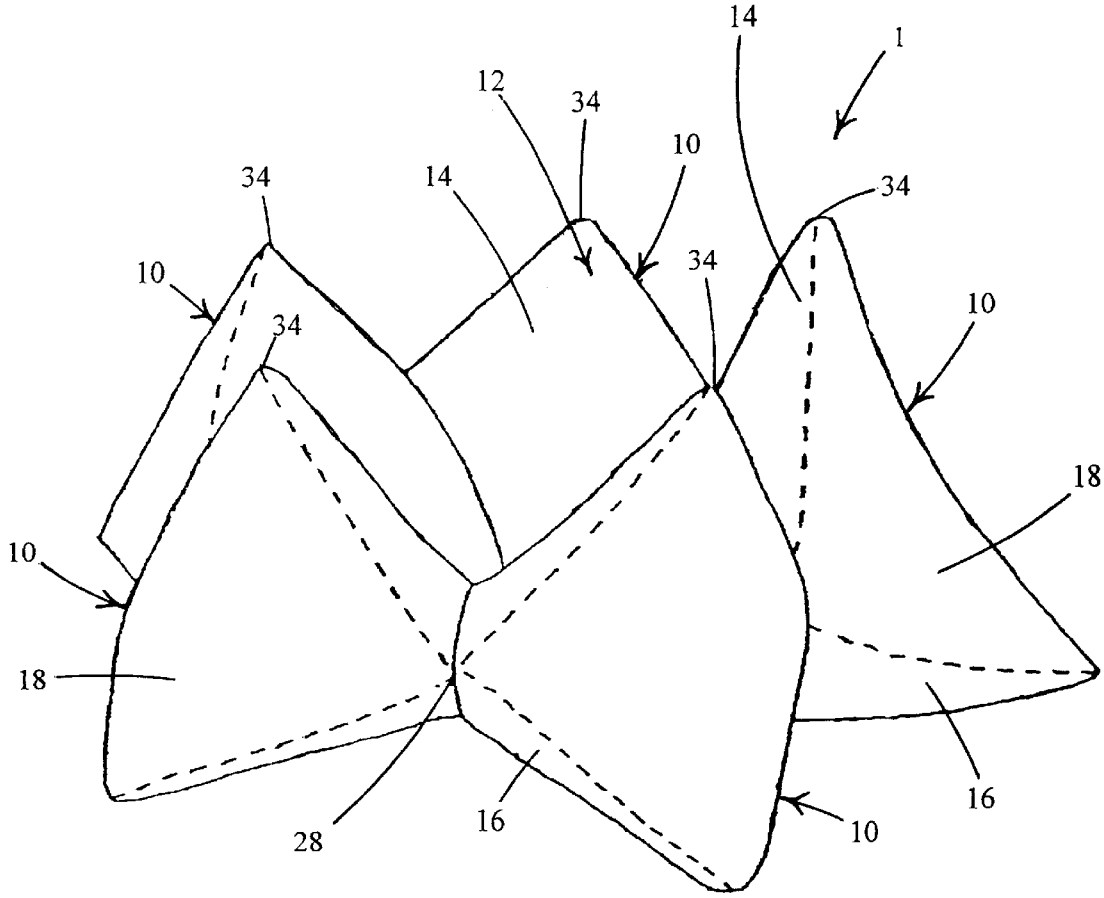
FIG. 1 is a perspective view of the pliable chair of the present invention.

The present invention is a 3-dimensional star-shaped pliable chair 1 for supporting a person sitting thereon, while also providing anatomically correct support for the user's five extremities (legs, arms and head). The chair 1 is illustrated in FIG. 1, and includes five compartments 10 joined together to form a shell 12. Each compartment 10 forms one of the five points of the pliable chair's star shape.

Figure 2:
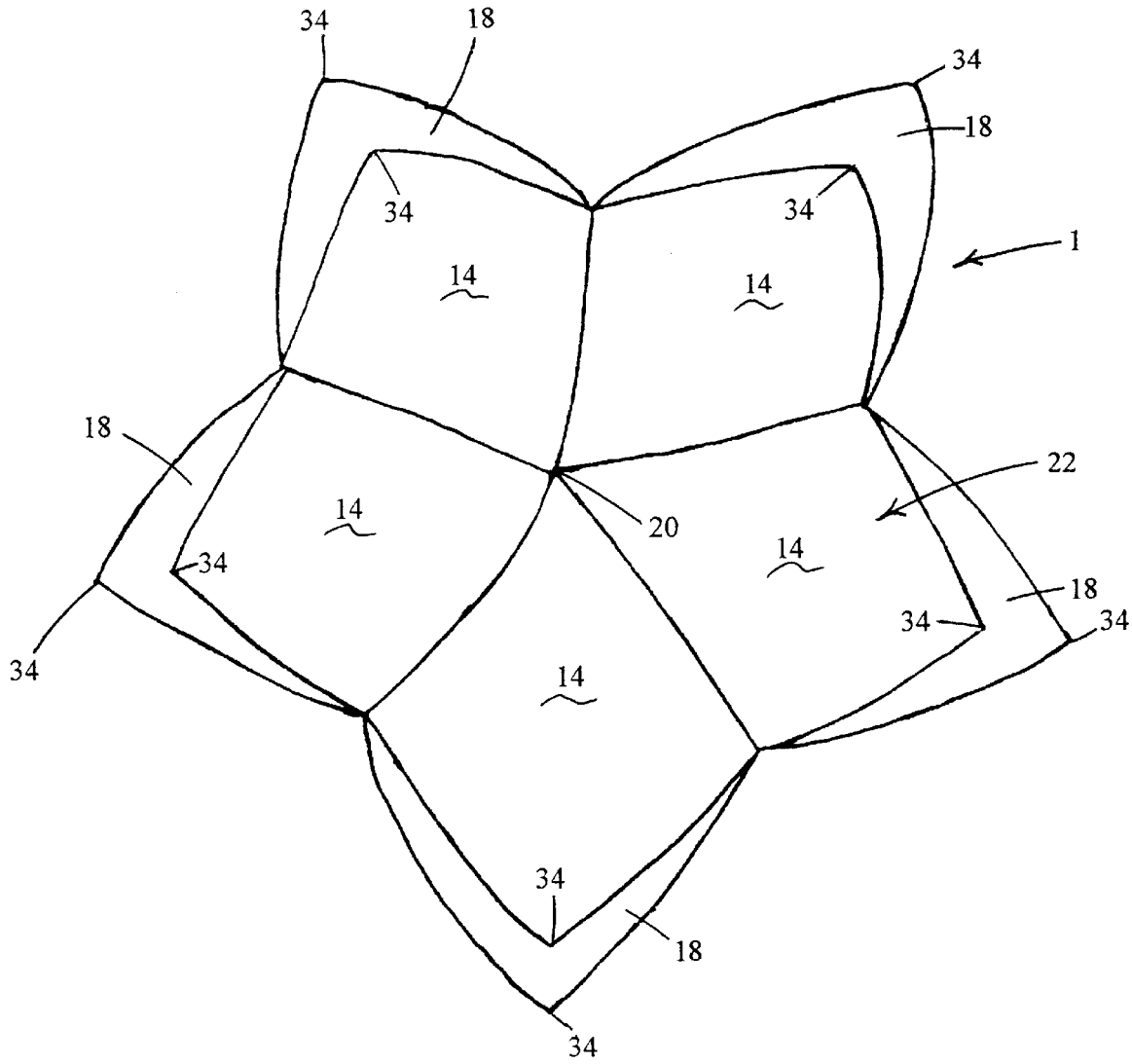
FIG. 2 is a top view of the pliable chair of the present invention.
Figure 3:
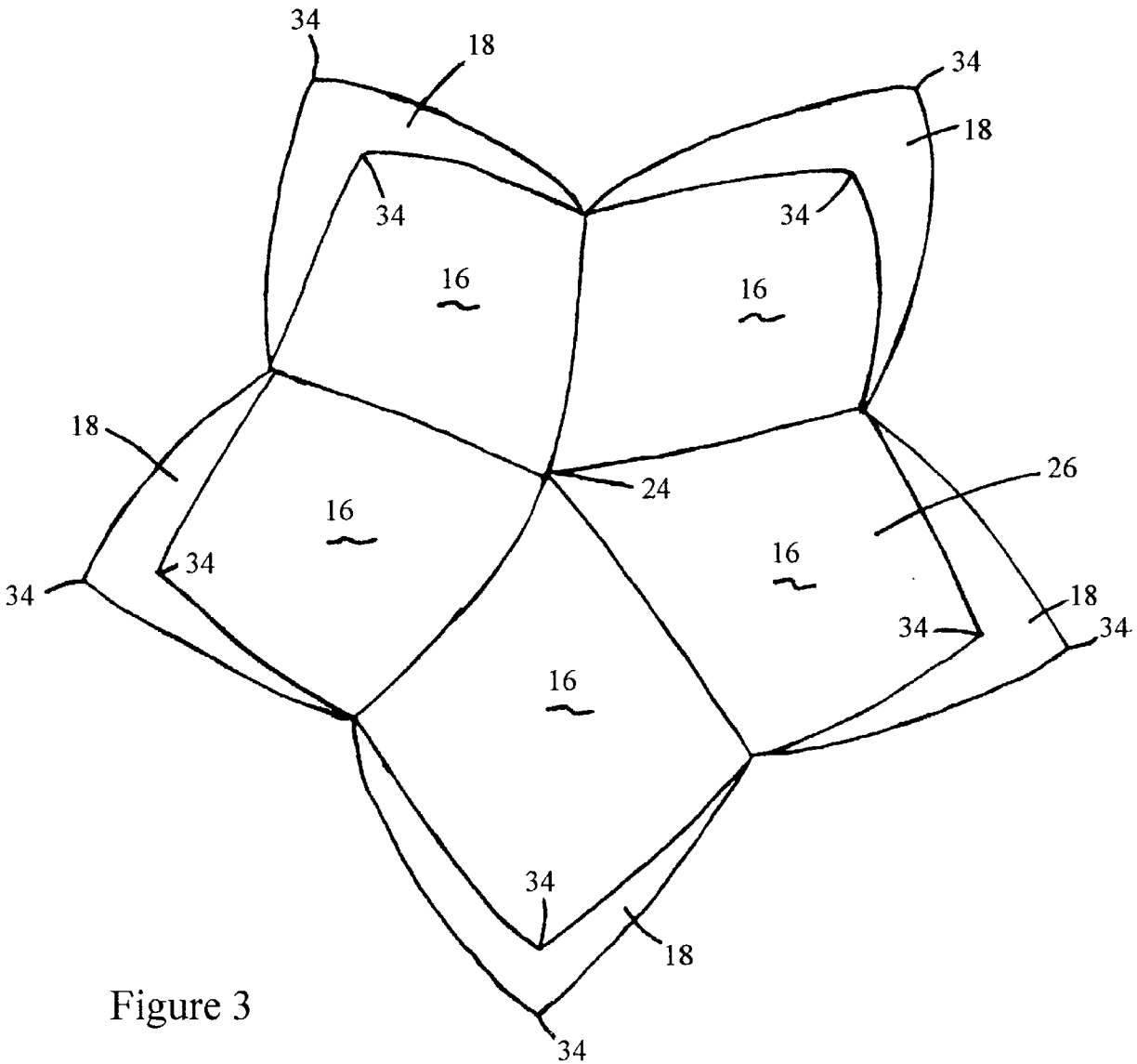
FIG. 3 is a bottom view of the pliable chair of the present invention.

In the preferred embodiment, the shell 12 is formed by fifteen square panels: five top panels 14, five bottom panels 16, and five side panels 18. The shell has a top surface 22 formed by the five top panels 14 attached together, a bottom surface 26 formed by the five bottom panels 16 attached together, and a side surface formed by the five side panels 18. Each of the top panels 14 has two side edges that are attached to side edges of adjacent top panels 14, and one corner that meets at a first common point 20, as illustrated in FIG. 2. The bottom panels 16 are configured in a similar manner, with each bottom panel 16 having two side edges that are attached to side edges of adjacent bottom panels 16, so that each bottom panel 16 has one corner that meets at a second common point 24, as illustrated in FIG. 3.

The five compartments 10 are each formed by opposing top and bottom panels 14/16, and the side panel 18 connected therebetween. Each side panel 18 that has two of its side edges attached to two side edges of the respective top panel 14, and its other two side edges attached to two side edges of the respective bottom panel 16. Adjacent compartments 10 meet at third common points 28, where six panel corners meet, one from each of two adjacent top panels 14, two adjacent bottom panels 16 and two adjacent side panels 18.

The top, bottom and side panels 14/16/18 can be formed of any pliable material that creates a comfortable surface for sitting, such as canvas, vinyl, fake fur, denim, naugahide, upholstery fabric, plastic, leather or any other equally heavy material. The various panels are attached together preferably with sewn stitches, but any conventional attachment scheme appropriate for the material used can be employed, such as adhesive, tape, welding, melting, etc.

The interior of the pliable chair is partially filled with particulate 30, such as pellets or beads that are well known in the art. The particulate 30 can be inserted before all the seams are stitched closed, or preferably a sealable opening is formed, for example using a zipper, so that the particulate 30 can be inserted after the pliable chair 1 is completed, and additional particulate can be added later if the particulate 30 compresses over time.

Figure 4:
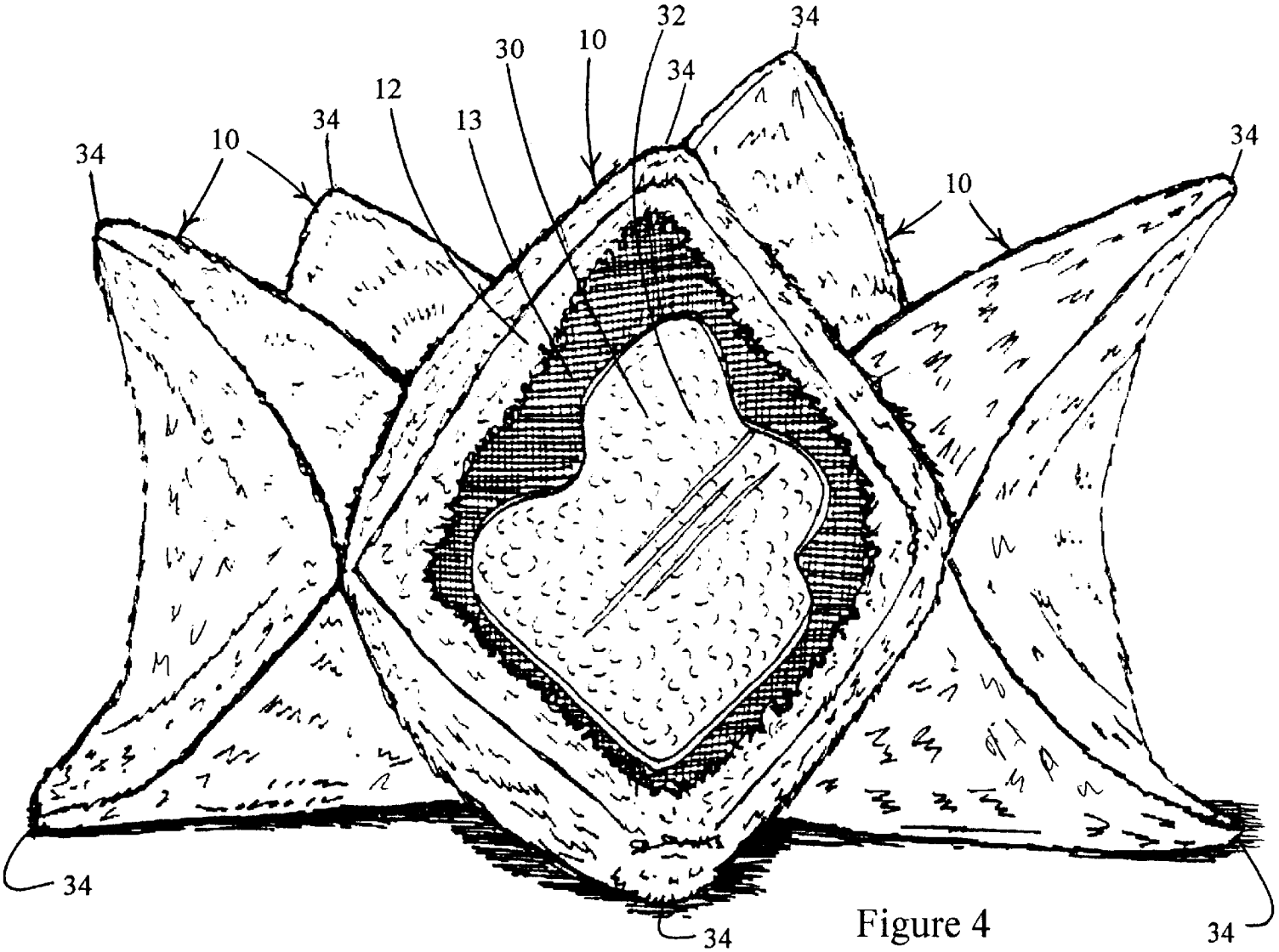
FIG. 4 is a side view of the pliable chair of the present invention.

The material used to form shell 12 is preferably resistant to stretching or ripping over time, yet is comfortable to the user. To insure durability over time, the preferred embodiment uses an inner shell 13 formed in the same manner and with the same dimensions as shell 12. Inner shell 13 is disposed immediately inside of shell 12, but is made with a sturdy material (such as plastic or tightly woven canvas) that will better contain the particulate without excessive stretching, even if the (outer) shell 12 is ripped. The use of inner shell 13 allows the use of a more elastic, comfortable material for the (outer) shell 12. Further, outer shell 12 can be removed for repair or cleaning, or even replaced with a different color or texture. FIG. 4 illustrates a window 32, made of clear plastic, that can be added to reveal the particulate 30 and inner shell 13.

Shell 12 and/or shell 13 can be reinforced by using interfacing, cross-grain ribbons or ropes. Preferably, when forming shells 12 and 13, the warp of one panel is placed perpendicular to the weft of the one it is being joined to. Alternately, the various panels 14/16/18 can be initially formed of a composition of multiple layers of materials before they are sewn or adhered together.

Figure 5:
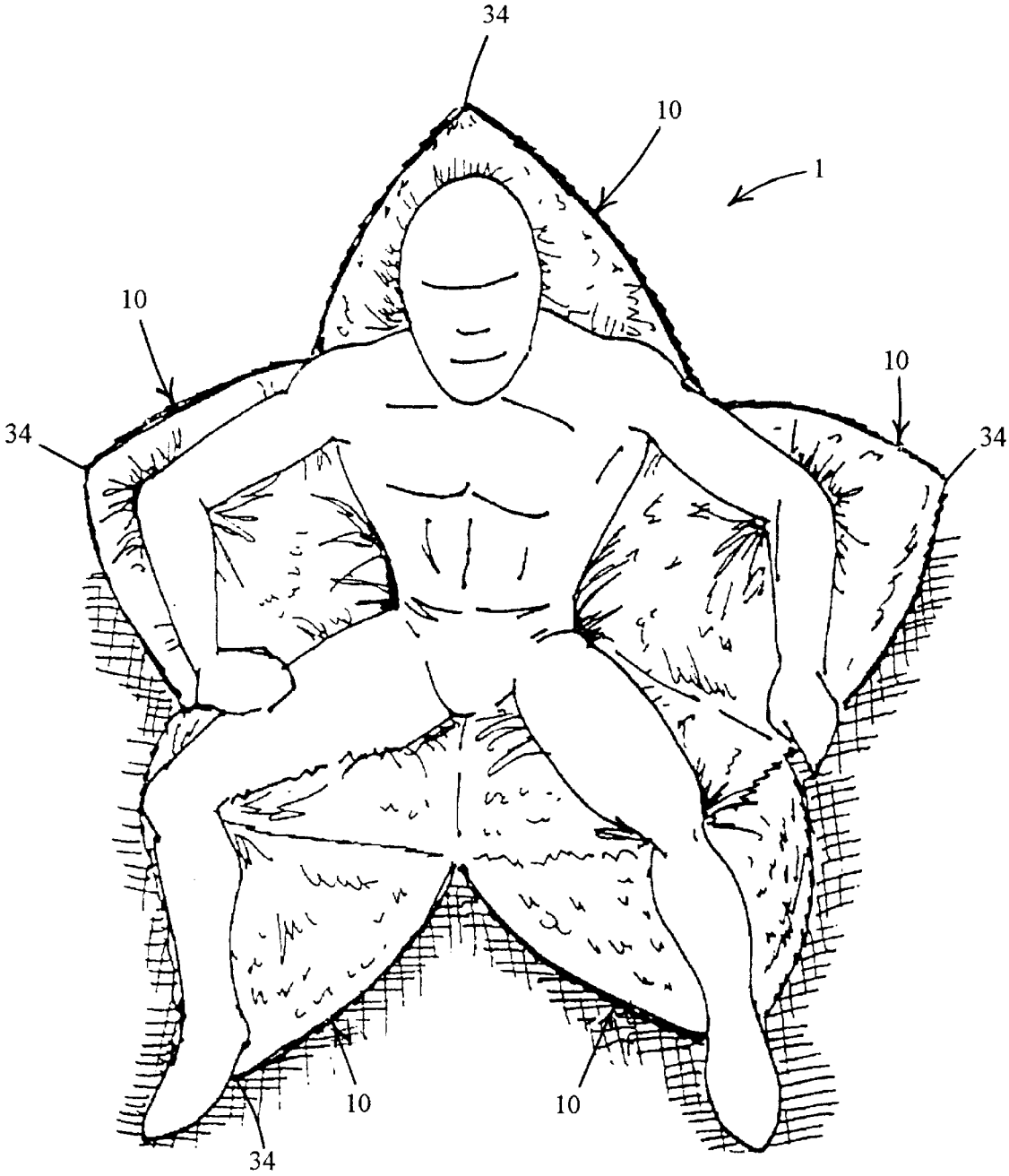
FIG. 5 is a perspective view of a user sitting on the pliable chair of the present invention.

Once the pliable chair 1 is filled with particulate 30, it forms the three dimensional fivepointed star shape shown in FIG. 1. Each of the compartments 10 form one of the five points of the chair, and each compartment 10 has a pair of protrusions 34, one extending up to help support the user and one extending down to support the compartment 10 on a support surface (e.g. floor). As the user sits in the center of the chair (e.g. on the first common point 20), the particulate 30 inside the chair is displaced into and expands the five compartments 10. The compartments 10 each provide separate support for one of the user's five extremities. Thus, one compartment 10 supports the user's back and head, two other compartments 10 support the user's arms, and the last two compartments 10 support the user's legs, as illustrated in FIG. 5. The support provided to each extremity is firm, but adjustable. The user can change the relative amount of particulate in each compartment 10, and thus its firmness, by pushing down on one or more of the upwardly extending compartment protrusions 34, thus forcing more particulate into other compartments 10. For example, by pushing down on the compartment 10 supporting the head and back, it becomes less firm, while the compartments 10 supporting the arms and/or legs become more firm. Further, by pushing down on more than one of the protrusions 34, the overall stiffness of the chair can be increased.

The preferred embodiment has been reduced to practice using 15 equal sized squares (20"×20") that are sewn together. First the top surface 22 is made using five top panels 14 to form a five pointed star that will not lay flat because of the irregularly shaped excess material. The bottom surface 26 is made in the same manner. The five points of the top surface 22 are aligned to the five points of the bottom surface 26, and the two surfaces are joined together by attaching the side panels 18. The particulate used was styrofoam pellets, $1/16^{th}$ to $3/8^{th}$ inch diameter.

In the preferred embodiment, there are no interior walls, so the particulate is free to move between compartments 10. However, selected seams on the top surface 22 can be attached or adhered to seams on the bottom surface 26 either directly or with the use of additional material, to restrict movement of the particulate between some or all the compartments 10. Restricting particulate movement allows the user to move around on the chair with less distortion of the compartments 10.

Figure 6:
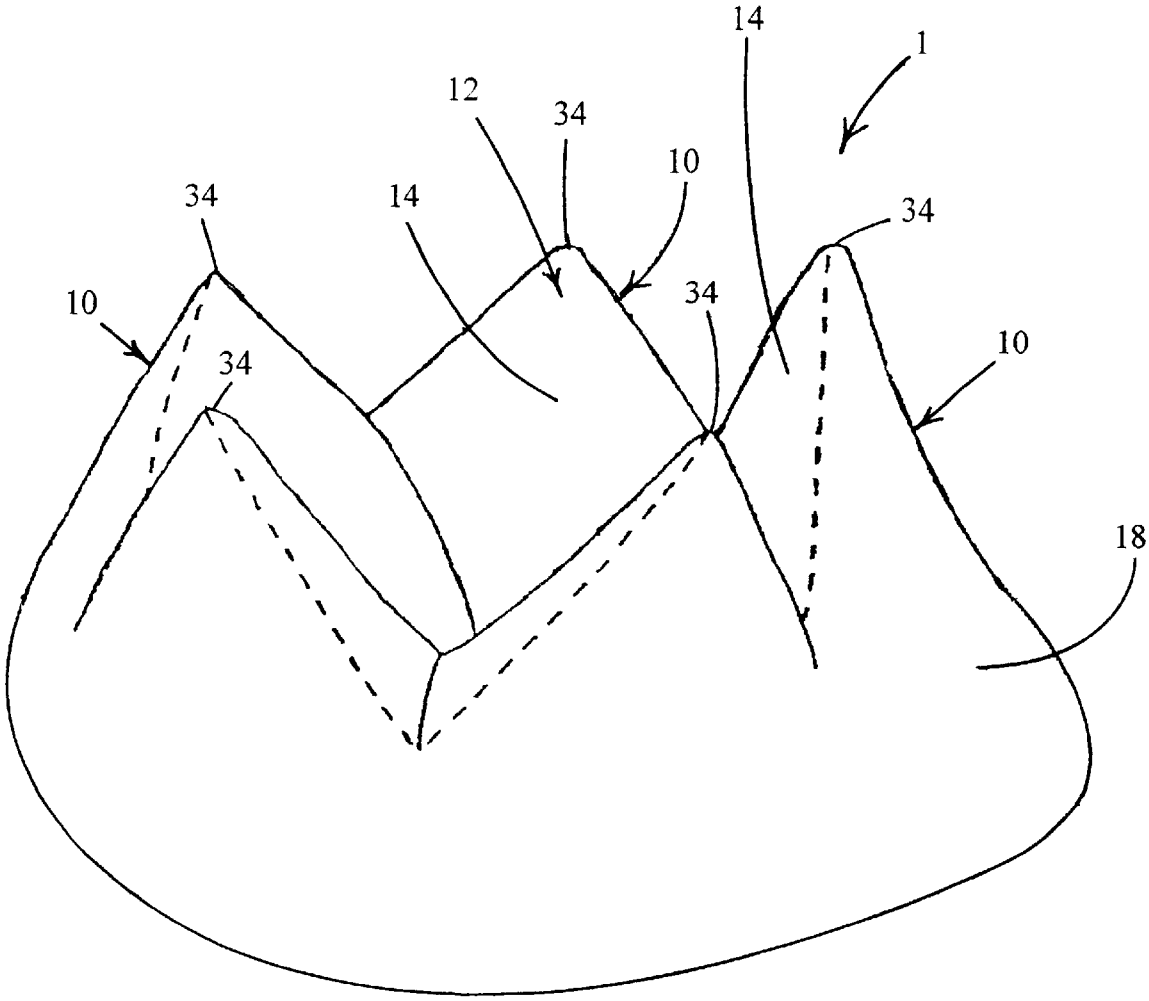
FIG. 6 is a perspective view of an alternate embodiment of the pliable chair of the present invention.

FIG. 6 illustrates an alternate embodiment, where the bottom surface is made without segregated panels and downwardly extending protrusions. Instead, side panels 18 are attached to material forming the bottom surface 26, or integrally formed therewith as shown in FIG. 6.

It is to be understood that the present invention is not limited to the embodiments described above and illustrated herein, but encompasses any and all variations falling within the scope of the appended claims. For example, some of the panels 14/16/18 forming one or more of the compartments 10 could be diamond shaped instead of square, so that one or more of the. protrusions of the compartments 10 are raised. Likewise, the size of one or more compartments 10 can be enlarged using irregularly shaped panels 14/16/18 to provide varying support for different user extremities (e.g. enlarge just one compartment to provide greater support for the head and back of a taller person). Such an embodiment could utilize panels with two shorter side edges and two longer side edges, or side panels 18 shaped in the form of regular and/or irregular hexagons that provide additional side edges for attachment between side panels, for providing a uniform or varying band of material that completely separates the top and bottom surfaces 22/26 (i.e. third common point 28 split apart so that corners in top surface panels do not meet corners in bottom surface panels), and for raising the level of the chair. The shells 12 and/or 13 can be formed in an airtight manner (e.g. made of plastic or rubber panels attached together using an air tight sealant), and the particulate 30 replaced with air, to provide an inflatable chair 1. Foam or other compressible materials could be used to fill the interior of the chair 1 instead of particulate 30. Additional compartments and protrusions can be included, and the number and shape of the panels forming the compartments can vary, so long as five compartments are formed to support the extremities of the user. Lastly, any of the above mentioned features may be combined together to form the chair of the present invention.

What is claimed is:

1. A pliable chair for supporting a user's extremities, comprising:

a hollow shell made of a pliable material, the hollow shell includes:

a center portion and at least five compartments extending therefrom, at least five upper panels attached together to form an upper surface, and at least five side panels each attached to one of the upper panels, wherein each of the compartments is defined by one of the upper panels and one of the side panels attached thereto; and particulate material contained within the shell;

wherein as a user sits on the center portion, a portion of the particulate material shifts into the compartments and provides support for the user's extremities.

2. The pliable chair of claim 1, wherein each of the compartments terminates in a protrusion.

3. The pliable chair of claim 1, wherein each of the compartments terminates in an upwardly extending protrusion and a downwardly extending protrusion.

4. The pliable chair of claim 1, wherein one of the compartments is greater in size than another one of the compartments.

5. A pliable chair for supporting a user's extremities, comprising:

a hollow shell made of a pliable material, the hollow shell includes:

a center portion and at least five compartments extending therefrom, at least five upper panels attached together to form an upper surface, at least five lower panels attached together to form a lower surface, and at least five side panels each attached to one of the upper panels and to one of the lower panels, wherein each of the compartments is defined by one of the upper panels, one of the lower panels, and one of the side panels attached thereto; and particulate material contained within the shell;

wherein as a user sits on the center portion, a portion of the particulate material shifts into the compartments and provides support for the user's extremities.

6. The pliable chair of claim 5, wherein:

each of the upper panels includes:

first and second side edges that are attached to first and second side edges of adjacent upper panels, and third and fourth side edges that are attached to first and second side edges of one of the side panels;

each of the lower panels includes:

first and second side edges that are attached to first and second side edges of adjacent lower panels, and third and fourth side edges that are attached to first and second side edges of one of the side panels.

7. The pliable chair of claim 6, wherein the upper panels, the lower panels and the side panels are all square in shape.

8. The pliable chair of claim 6, wherein the upper panels, the lower panels and the side panels are all diamond shaped.

9. The pliable chair of claim 5, wherein at least a portion of the upper surface is connected to at least a portion of the lower surface to restrict flow of the particulate to and from at least one of the compartments.

10. A pliable chair for supporting a user's extremities, comprising:

a hollow shell made of a pliable material, the shell includes:

five upper panels attached together to form an upper surface;

five lower panels attached together to form a lower surface;

five side panels each attached to one of the upper panels and to one of the lower panels; and particulate material contained within the shell;

wherein five compartments extend from a central portion of the shell in a star shape, each compartment is defined by one of the upper panels, one of the lower panels, and one of the side panels attached to the one upper panel and the one lower panel; and wherein as a user sits on the center portion, a portion of the particulate material shifts into the compartments and provides support for the user's extremities.

11. The pliable chair of claim 10, wherein each of the compartments terminates in an upwardly extending protrusion and a downwardly extending protrusion.

12. The pliable chair of claim 10, wherein:

each of the upper panels includes:

first and second side edges that are attached to first and second side edges of adjacent upper panels, and third and fourth side edges that are attached to first and second side edges of one of the side panels;

each of the lower panels includes:

first and second side edges that are attached to first and second side edges of adjacent lower panels, and third and fourth side edges that are attached to first and second side edges of one of the side panels.

13. The pliable chair of claim 10, wherein the upper panels, the lower panels and the side panels are all square in shape.

14. The pliable chair of claim 10, wherein the upper panels, the lower panels and the side panels are all diamond shaped.

15. The pliable chair of claim 10, wherein one of the compartments is greater in size than another one of the compartments.

16. The pliable chair of claim 10, wherein at least one portion of the upper surface is connected to at least one portion of the lower surface to restrict flow of the particulate to and from at least one of the compartments.

* * * * *